US012370419B2

(12) United States Patent
Cleghorn et al.

(10) Patent No.: US 12,370,419 B2
(45) **Date of Patent: *Jul. 29, 2025**

(54) GOLF CLUB HEAD WITH IMPROVED PERFORMANCE

(71) Applicant: Acushnet Company, Fairhaven, MA (US)

(72) Inventors: Richard L. Cleghorn, Oceanside, CA (US); Peter L. Soracco, Carlsbad, CA (US); Ryuichi Sugimae, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 70 days.

This patent is subject to a terminal disclaimer.

(21) Appl. No.: 18/320,316

(22) Filed: May 19, 2023

(65) Prior Publication Data

US 2023/0285813 A1 Sep. 14, 2023

Related U.S. Application Data

(63) Continuation of application No. 17/381,458, filed on Jul. 21, 2021, now Pat. No. 11,691,055.

(51) Int. Cl.
*A63B 53/04* (2015.01)

(52) U.S. Cl.
CPC ..... *A63B 53/0466* (2013.01); *A63B 2209/00* (2013.01)

(58) Field of Classification Search
CPC . A63B 53/04; A63B 53/0408; A63B 53/0466; A63B 2053/0491; A63B 53/047
See application file for complete search history.

(56) References Cited

U.S. PATENT DOCUMENTS 1,318,325 A * 10/1919 Klin ..... A63B 53/0466 473/337
1,467,435 A * 9/1923 Kinnear ..... A63B 53/0466 473/337
1,502,328 A * 7/1924 Beat ..... A63B 60/00 473/344
1,525,352 A * 2/1925 Aitken ..... A63B 53/0466 473/344
1,543,691 A * 6/1925 Beat ..... A63B 53/08 473/342

(Continued)

FOREIGN PATENT DOCUMENTS

EP 0662329 A1 * 7/1995
FR 535744 A * 4/1922

(Continued)

*Primary Examiner* — Alvin A Hunter

(74) *Attorney, Agent, or Firm* — Randy K. Chang

(57) ABSTRACT

A golf club head with an improved Center of Gravity (CG) location is disclosed. More specifically, the present invention relates to a metalwood type golf club head with improved performance via shifting the CG towards a location that reduces spin, at the same time, without sacrificing launch angle and the forgiveness of the golf club head. This golf club head may generally have a unique construction capable of achieving a low and forward CG location that is less than 40 mm from the face center along a Z-axis, a CG height that is no more than 2 mm above the neutral axis, and a MOI-Y of greater than about 4,000 g-cm$^2$.

14 Claims, 14 Drawing Sheets

(56) References Cited

U.S. PATENT DOCUMENTS 1,968,627 A * 7/1934 Young ..... A63B 60/00 473/349
4,332,388 A * 6/1982 Crow ..... A63B 60/00 473/328
4,793,616 A 12/1988 Fernandez
5,154,425 A 10/1992 Niskanen et al.
5,158,289 A * 10/1992 Okumoto ..... A63B 53/0466 473/319
6,074,310 A 6/2000 Ota
6,254,494 B1 * 7/2001 Hasebe ..... A63B 53/04 473/345
6,409,612 B1 6/2002 Evans et al.
6,482,104 B1 * 11/2002 Gilbert ..... A63B 53/04 473/287
6,676,535 B2 1/2004 Sheets et al.
6,769,998 B2 * 8/2004 Clausen ..... A63B 53/0466 473/349
6,887,165 B2 * 5/2005 Tsurumaki ..... A63B 53/0466 473/344
7,338,389 B2 * 3/2008 Wieland ..... A63B 53/047 473/349
7,682,262 B2 * 3/2010 Soracco ..... A63B 53/0466 473/345
7,811,180 B2 * 10/2010 Roach ..... C25D 11/243 473/349
8,043,165 B2 * 10/2011 Galloway ..... A63B 53/047 473/328
8,668,599 B1 * 3/2014 Cackett ..... A63B 60/00 473/335
8,727,909 B2 * 5/2014 Guerrette ..... A63B 53/047 473/324
9,033,817 B2 * 5/2015 Snyder ..... A63B 60/54 473/332
9,662,545 B2 * 5/2017 Beach ..... A63B 60/52
10,052,533 B1 * 8/2018 Kuc ..... A63B 53/0466
10,086,238 B1 * 10/2018 Roach ..... A63B 60/42
11,033,788 B1 * 6/2021 Hobbs ..... A63B 53/047
11,691,055 B2 * 7/2023 Cleghorn ..... A63B 53/0466 473/349
2002/0013180 A1 * 1/2002 Kajita ..... A63B 53/04 473/324
2002/0160853 A1 * 10/2002 Miyamoto ..... A63B 53/0466 473/330
2003/0181259 A1 * 9/2003 Shimazaki ..... A63B 53/047 473/349
2004/0058745 A1 * 3/2004 Clausen ..... A63B 53/0466 473/349
2005/0003900 A1 * 1/2005 Sugimoto ..... A63B 53/047 473/290
2006/0079349 A1 * 4/2006 Rae ..... A63B 53/0466 473/345
2006/0128501 A1 * 6/2006 Rice ..... A63B 60/42 473/345
2006/0148587 A1 * 7/2006 Stevens ..... A63B 60/02 473/345
2008/0051210 A1 * 2/2008 Park ..... A63B 53/047 473/290
2008/0051218 A1 * 2/2008 Rae ..... A63B 53/0466 473/349
2008/0096688 A1 * 4/2008 Yokota ..... A63B 60/02 473/345
2008/0161124 A1 * 7/2008 Kajita ..... A63B 53/0466 473/330
2008/0318705 A1 * 12/2008 Clausen ..... A63B 53/047 473/332
2009/0017937 A1 * 1/2009 Oyama ..... A63B 53/0466 473/345
2009/0137338 A1 * 5/2009 Kajita ..... A63B 71/146 473/345
2009/0253533 A1 * 10/2009 Hirano ..... A63B 53/0466 473/345
2010/0151960 A1 * 6/2010 Wahl ..... A63B 53/0466 473/347
2010/0331106 A1 * 12/2010 Golden ..... A63B 60/00 473/345
2011/0263349 A1 * 10/2011 Kodama ..... A63B 53/0466 473/330
2012/0129627 A1 * 5/2012 Hirano ..... A63B 53/0466 473/346
2013/0017904 A1 * 1/2013 Woolley ..... A63B 53/047 473/342
2013/0116065 A1 * 5/2013 Yamamoto ..... A63B 53/0466 473/345
2013/0225320 A1 * 8/2013 Woolley ..... A63B 53/047 473/347
2014/0274454 A1 * 9/2014 Snyder ..... A63B 53/047 473/332
2014/0274464 A1 * 9/2014 Schweigert ..... A63B 53/04 473/349
2015/0111664 A1 * 4/2015 Myrhum ..... A63B 60/00 473/342
2015/0297958 A1 * 10/2015 Hebreo ..... A63B 53/047 473/350
2016/0354657 A1 * 12/2016 Beach ..... A63B 60/02
2017/0065858 A1 * 3/2017 Tassistro ..... A63B 60/02
2018/0043222 A1 2/2018 Fossum et al.
2018/0078832 A1 * 3/2018 Stokke ..... A63B 53/04
2018/0140907 A1 * 5/2018 Jertson ..... A63B 53/0466
2018/0189758 A1 * 7/2018 Beach ..... G06Q 20/18
2020/0013035 A1 * 1/2020 Long ..... G06Q 20/18
2021/0264394 A1 * 8/2021 Long ..... A63B 53/0475

FOREIGN PATENT DOCUMENTS

JP H05293201 A * 11/1993
JP 2004242938 A * 9/2004 ..... A63B 3/0466
JP 2008100056 A * 5/2008 ..... A63B 53/04
JP 2009018112 A * 1/2009 ..... A63B 53/0466
JP 2011005253 A * 1/2011 ..... A63B 53/0466
JP 2021104358 A * 7/2021 ..... A63B 53/04
KR 20040025829 A * 3/2004
KR 20110046471 A * 5/2011
TW M319063 U * 9/2017

* cited by examiner

GOLF CLUB HEAD WITH IMPROVED PERFORMANCE

CROSS-REFERENCE TO RELATED APPLICATIONS

The present application is a Continuation (CON) of U.S. patent application Ser. No. 17/381,458, filed on Jul. 21, 2021, the disclosure of which is incorporated by reference in its entirety.

FIELD OF THE INVENTION

The present invention relates generally to a metalwood type golf club head with improved performance via shifting of the Center of Gravity (CG) towards a location that reduces spin, at the same time without sacrificing launch angle and the forgiveness of the golf club head. More specifically, the present invention relates to a metalwood type golf club head with an unique construction that allows the golf club head to have a low and forward CG location that is less than 40 mm from the face center along a Z-axis, a CG height that is no more than 2 mm above the neutral axis, and a MOI-Y of greater than about 4,000 g-cm$^2$.

BACKGROUND OF THE INVENTION

In order to move the center of gravity around in a golf club to more desirable locations to improve performance, golf club designers often experiment with utilization of multiple materials of different density.

In one early example, the basic concept of using multiple materials in a golf club head is shown U.S. Pat. No. 5,154,425 to Niskanen et al wherein composite type material is introduced to a golf club head using different joining techniques involving a metal matrix, a composite matrix, and/or even a ceramic matrix in a golf club head.

U.S. Pat. No. 4,793,616 to Fernandez teaches the utilization of a lightweight composite material to remove excess weight from undesirable portions of a golf club head. More specifically, U.S. Pat. No. 4,793,616 talks about using lightweight composite material that is molded to a hard, high density material, to provide selected distribution and localization of mass within the golf club head.

U.S. Pat. No. 6,409,612 to Evans et al. teaches the utilization of plurality of high density members that are tungsten spheres to shift weight to a desirable portion of a golf club head.

Combining all of the teachings known, it can be seen that by utilizing multiple materials that can be both lightweight and high density, the properties of the golf club head could be significantly manipulated. How to manipulate these properties to achieve the best performing golf club head, on the other hand, is the true challenge.

One of the known ways to manipulate the property of a golf club head is to shift the center of gravity lower on a golf club head to help promote higher launch. U.S. Pat. No. 6,074,310 to Ota illustrates this concept despite not using multiple materials by manipulating the wall thickness of various portions of a golf club head to create a center of gravity that is relatively low.

Another way to manipulate the property of a golf club head is to shift the center of gravity deep towards the back of the golf club head to promote not only high launching golf club heads, but also ones that can be forgiving. U.S. Pat. No. 6,676,535 to Sheets et al. illustrates this with a title of a Golf Club Head Having a Low and Deep Weight Distribution achieved via manipulation of the sole contours of the golf club head.

However, these type of low and deep center of gravity locations, although may be capable of achieving golf club heads with high launch and good forgiveness, sacrifice distance because it contains too much spin, which is a function of the CG location relative to the neutral axis. In order to reduce the spin, the CG location needs to be brought forward, which often comes at an expense of performance in other areas. Moreover, merely moving the CG forward within itself will not improve the performance of the golf club head, but rather, it is the ability to move the CG both forward and low that will result in overall performance of the golf club head without giving up performance elsewhere.

Unfortunately, in order to move the CG of the golf club head forward and low, it involves the manipulating the leading edge of a golf club head, a portion of the golf club head that is extremely sensitive to changes, as it experiences high stresses when in contact with a golf ball, and can often yield undesirable sacrifices in the coefficient of restitution of the face portion of the golf club head.

Hence, based on the above, it can be seen that there is a need in the art for a golf club head that is capable of utilizing multi-material technology in a golf club head that can achieve a low and forward CG location without sacrifices to the other performance criteria of the golf club head.

BRIEF SUMMARY OF THE INVENTION

One aspect of the present invention is a golf club head comprising of a striking face portion located at a frontal portion of the golf club head, and a body portion, made out of a first material having a first density, attached to the rear of the striking face portion. The striking face portion further comprising of an upper striking face portion located above a geometric center of the striking face portion and a lower striking face portion located below the geometric enter of the striking face portion, wherein at least a portion of the striking face portion further comprises of a weighting mechanism that encompasses a leading edge portion of the golf club head. The golf club head has a CG-Z-FC of less than about 40 mm from a face center, a CG-NA of less than about 2 mm above a neutral axis, and a MOI-Y of greater than about 4,000 g-cm$^2$.

In another aspect of the present invention is a golf club head a striking face portion located at a frontal portion of the golf club head, and a body portion, made out of a first material having a first density, attached to the rear of the striking face portion. The striking face portion further comprising of an upper striking face portion located above a geometric center of the striking face portion and a lower striking face portion located below the geometric enter of the striking face portion, wherein at least a portion of the striking face portion further comprises of a weighting mechanism. The weighting mechanism further comprises of a high density member, made out of a second material having a second density, and an attachment member, adapted to engage an opening in the high density member, wherein the second density is greater than a first density, wherein the attachment member secures the high density member to a leading edge portion of the golf club head, and wherein the weighting mechanism encompasses a portion of the leading edge portion of the golf club head.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
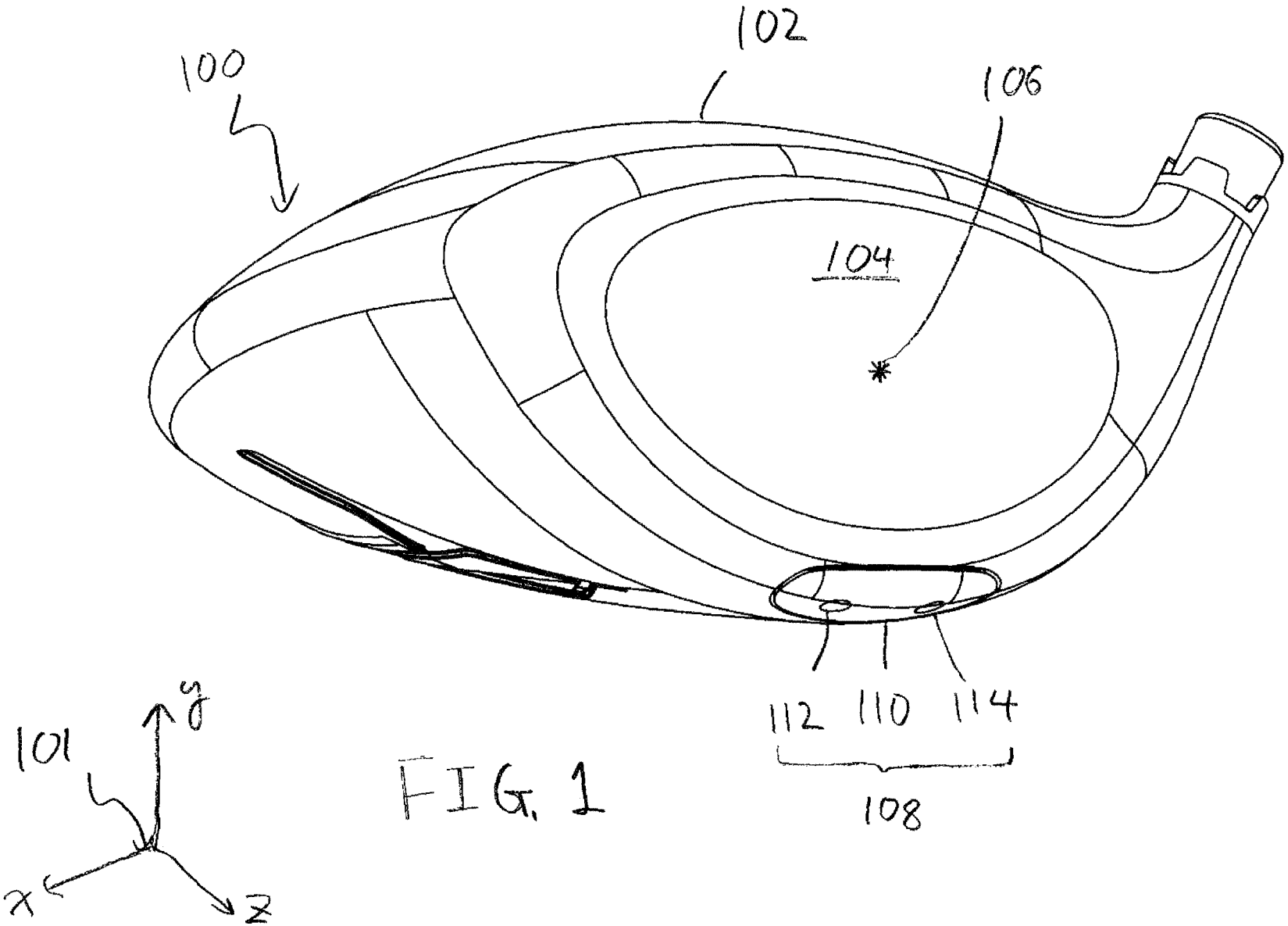
FIG. 1 of the accompanying drawings shows a perspective view of a golf club head in accordance with an exemplary embodiment of the present invention.

FIG. 1 of the accompanying drawings shows a perspective frontal view of a golf club head 100 in accordance with an exemplary embodiment of the present invention. More specifically, a closer examination of FIG. 1 shows several sub-components of the golf club head 100 that's made mainly from a frontal striking face portion 104 and a body portion 102, with the body portion 102 attached to a rear of the striking face portion 104. The striking face portion 104, although shown in FIG. 1 as being located at a face insert portion of a golf club head 100, is not limited to the face insert. In fact, the striking face portion 104 refers generally to the portion of the golf club head 100 that is adapted to make contact with a golf ball, and refers to the portion of the golf club head 100 that is substantially planar at the frontal portion of the golf club head 100. In a face insert type of construction as shown in FIG. 1, the striking face portion 104 includes the face insert itself as well as the surrounding flange portion of the cast body without departing from the scope and content of the present invention. In an alternative embodiment of the present invention where a face cup type construction is used, the striking face portion 104 may exclude the return portion of the face cup and refer purely to the substantially planar portion of the golf club head 100.

FIG. 1 of the accompanying drawings also highlights a geometric face center 106, which is located at a geometric center of the striking face portion 104, at the frontal most surface of the striking face portion 104 of the golf club head 100. Finally, FIG. 1 also shows a weighting mechanism 108 located at lower striking face portion of said striking face portion. The discussion of the distinction between the upper and lower striking face portion will be covered in more detail later in FIG. 3, but for now, it is suffice to say that the striking face portion 104 could be split up into an upper striking face portion and a lower striking face portion, separated from one another at the geometric face center 106. Hence, alternatively speaking, it can be said that the lower striking face portion of the striking face portion 104 further comprises a weighting mechanism 108. The weighting mechanism 108 shown here in this embodiment if further comprised out of a high density member 110, a toe biased attachment member 112, and a heel biased attachment member 114. The toe biased attachment member 112 and the heel biased attachment member 114 work in conjunction to connect the high density member 110 to a leading edge portion of the lower striking face portion of the golf club head 100. In this embodiment of the present invention, because the high density member 110 is secured to the golf club head 100 via a mechanical lock mechanism, the high density member 110 could be made from a high density tungsten material with a density of greater than about 14 g/cm$^3$, more preferably greater than about 15 g/cm$^3$, and most preferably greater than about 17 g/cm$^3$. In another alternative embodiment of the present invention, the high density member may be made out of a steel type material with a density of greater than about 7.5 g/cm$^3$, more preferably greater than about 7.65 g/cm$^3$, and most preferably greater than about 7.8 g/cm$^3$. Hence it can be seen that numerous types of material could be used to form the high density member 110 so long as it is capable of achieving the performance properties of the golf club head 100 to be set fourth later all without departing from the scope and content of the present invention.

Figure 2:
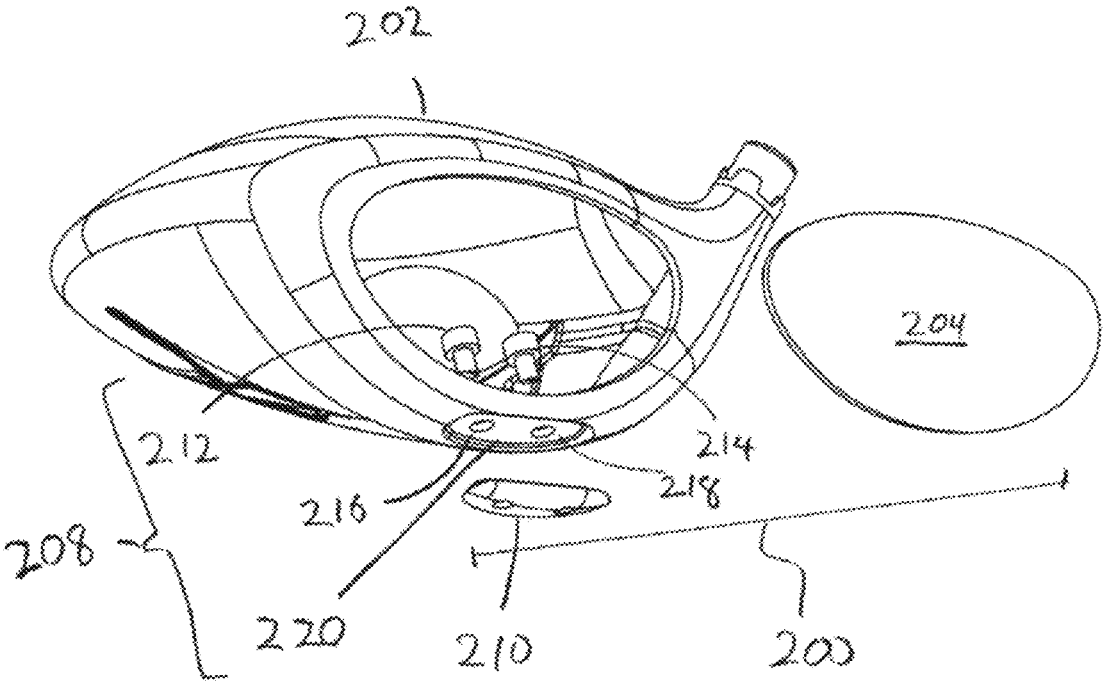
FIG. 2 of the accompanying drawings shows an exploded view of a golf club head in accordance with an exemplary embodiment of the present invention.

Before moving on to FIG. 2, it should be noted that FIG. 1 also shows a coordinate system 101, illustrating the orientation of the golf club head 100 relative to the coordinate system 101. More specifically, the x-axis spans in a heel to toe direction, with the positive direction pointed towards the toe. The y-axis spans in a direction of crown to sole, with the positive direction pointed towards the crown. Finally, the z-axis spans the direction of front to back, with the positive direction pointed towards the front of the golf club head 100. This coordinate system of references is applicable to all subsequent discussions of various other embodiments of the present invention.

In order to better illustrate the various components of the weighting mechanism 108 previously shown, an exploded view of a golf club head 200 is provided in FIG. 2. FIG. 2 of the accompanying drawings that provides an exploded view of the golf club head 200 wherein the various components of the weighting mechanism 208 and their relationship with one another are shown here. In FIG. 2, the face insert of the striking face portion 204 is exploded out from the surrounding flange portion to allow the internals of the golf club head 200 to be shown. With the face insert out of the way, we can see that both the toe biased attachment member 212 and the heel based attachment member 214 have an enlarged screw head portion located inside the golf club head 200, and an elongated threaded member that protrude out from toe biased opening 216 and heel biased opening 218 respectively. The toe biased opening 216 and the heel biased opening 218 are both formed within the weight port 220, with the weight port 220 adapted to engage the high density member 210. It is worth noting here that the material used to form the toe biased attachment member 212 and the heel biased attachment member 214 may generally be made out of same high density material with a density of greater than about 15 g/cm$^3$ as previously defined for the high density member 210, so they could be welded to one another to further enhance the bond of the weighted member 210 to the leading edge of the golf club head 100; however, in other embodiments, the material could be different and have higher or lower densities than the high density member 210 without departing from the scope and content of the present invention. Moreover, if different materials are used to create the high density member 210 and the attachment members 212 and 214, those material may not be directly weldable to one another, thus the strength of the bond may rely purely on the mechanical thread, swaging techniques, brazing techniques, gluing techniques, or other types of attachment mechanism also without departing from the scope and content of the present invention.

When the elongated protrusions of the toe biased attachment member 212 and the elongated protrusions of the heel biased attachment member 214 extend beyond the periphery of the high density member 210 itself via the openings previously discussed, the extra material can be removed and the terminal end of the elongated protrusions can be welded to the high density member 210 to provide the mechanical lock previously described. In addition to the above, the toe biased opening 216 and the heel biased opening 218, together with their corresponding openings in the high density member 210 could be threaded to accept the threaded elongated protrusion component of the toe biased attachment member 212 and the heel biased attachment member 214 respectively, further enhancing the strength of the bond between the various components. It should be noted here that although a threaded attachment mechanism is disclosed here is to be combined with welding to achieve the highest level of bond between the various components, various combination of the attachment methods such as threaded, welded, swaged, brazed, glued, or any combination thereof all without departing from the scope and content of the present invention. In some of these other embodiments, the threaded elongate protrusions may not even be threaded, and could just be simple posts that utilizes other attachment methods without threads to also be without departing from the scope and content of the present invention.

Figure 3:
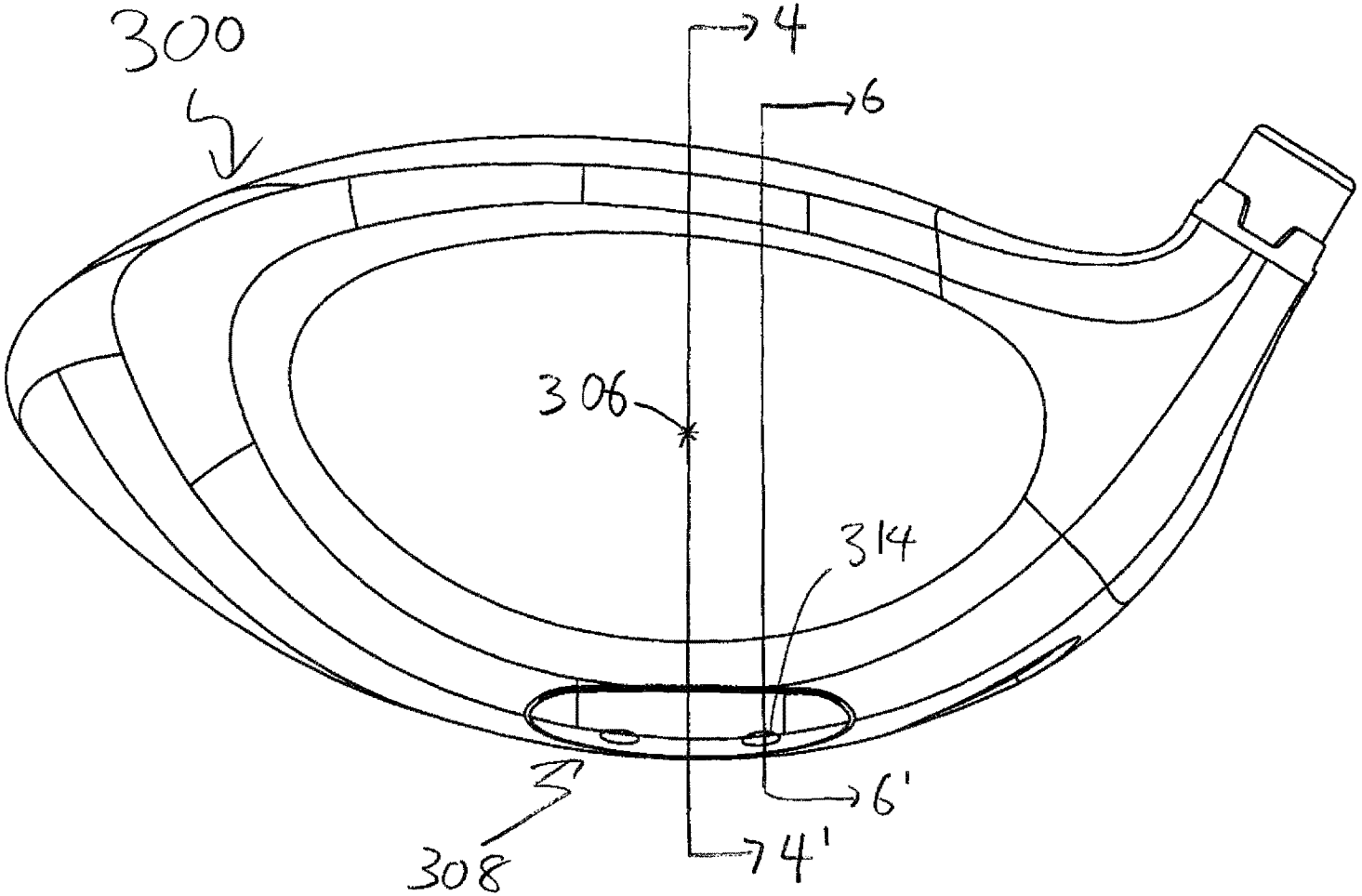
FIG. 3 of the accompanying drawings shows a frontal view of a golf club head in accordance with an exemplary embodiment of the present invention, showing cross-sectional lines 4-4' and 6-6'.

FIG. 3 of the accompanying drawings shows a frontal face on view of a golf club head 300 in accordance with an exemplary embodiment of the present invention. The frontal view of the golf club head 300 allows the cross-sectional lines 4-4' and 6-6' to be shown more clearly for subsequent figures. Cross-sectional line 4-4' passes through the golf club head 300 vertically through the geometric face center 306, cutting across the middle of the golf club head 300. Cross-sectional line 6-6' on the other hand, is another vertical cross-sectional line that passes through the middle of the heel biased attachment member 314 to allow the relationship between the various weighting mechanism 308 to be illustrated more clearly.

Figure 4:
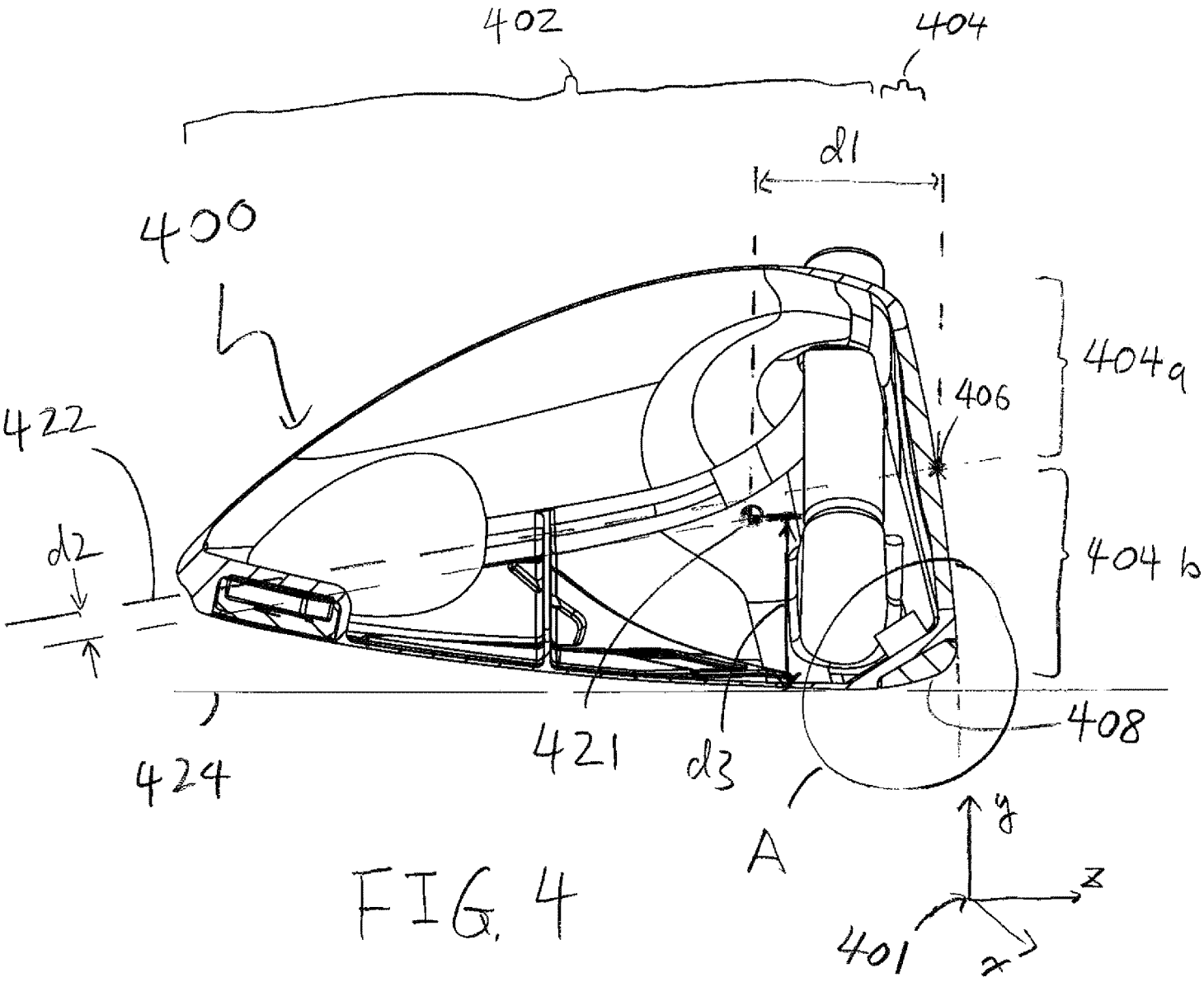
FIG. 4 of the accompanying drawings shows a cross-sectional view of a golf club head in accordance with an exemplary embodiment of the present invention taken along cross-sectional line 4-4' shown in FIG. 3.

FIG. 4 of the accompanying drawings shows a cross-sectional view of a golf club head 400 taken along a cross-sectional line 4-4' shown in FIG. 3 that passes through the geometric face center 406 in a forward and rear orientation. This cross-sectional view of the golf club head 400 allows numerous key components of the golf club head 400 to be shown more clearly, along with other measurements relating to the performance of the golf club head 400. First and foremost, we can see the distinction of the striking face portion 404 and the body portion 402 loosely defined in this view, allowing the separation to be more clearly shown in this orientation, affirming the definition above wherein the striking face portion 404 referring to the portion of the golf club head 400 that is substantially planar, and all portions of the golf club head 400 rearward of that substantially planar portion would be considered the rear body portion 402.

The cross-sectional view of the golf club head 400 shown here in FIG. 4 also allows the two sub-components of the striking face portion 404 previously discussed to be shown. More specifically, the striking face portion 404 can be separated into an upper striking face portion **404*a* and a lower striking face portion 404*b*, with the separation occurring at the geometric face center 406, where any portion of the striking face portion 404 that is above the geometric face center 406 along the y-axis would be considered the upper striking face portion 404*a*, and any portion of the striking face portion blow the geometric face center 406 along the y-axis would be considered the lower striking face portion 404*b***.

In addition to the above, FIG. 4 of the accompanying drawings also shows a Center of Gravity (CG) 421 location of the golf club head 400 and its relative position in the y-z plane as shown in this cross-sectional view. The location of the CG 421 in critical to the performance of the present inventive golf club head 400, as the weighting mechanism 408 located at the bottom of the lower striking face portion 404*b* shifts the CG 421 to a location previously unachievable without sacrifices to the Moment of Inertia (MOI) performance of the golf club head 400. The MOI numbers of the golf club head 400 in accordance with the present invention will be discussed in more detail in the subsequent disclosure. The CG 421 of the golf club head 400, in accordance with this exemplary embodiment of the present invention, is located at a distance d1 away from the geometric face center 406 along the z-axis as shown in this embodiment of the present invention. Distance d1, also referred to as CG-Z-FC, generally relates to the front to back location of the CG 421 of the golf club head 400, which generally affects the amount of spin a golf ball may exhibit when impacting the golf club head 400. Distance d1 may generally be less than about 40 mm, more preferably less than about 37.50 mm, and most preferably less than about 35.00 mm, all without departing from the scope and content of the present invention.

Having a forward CG 421 location is not the only thing that contributes to the improved performance of the golf club head 400. In addition to having a forward CG 421, the current inventive golf club head 400 may also have a low CG 421 location, which can be defined relative to a neutral axis 422 or a ground plane 424, and can be helpful in promoting a higher launching golf ball. In order to define CG 421 relative to the neutral axis 422, as depicted by distance d2 shown in FIG. 3, one needs to define the neutral axis 422 of the golf club head 400, which is defined as an axis that is perpendicular to the striking face portion 404 at the geometric face center 406 of the golf club head 400 as shown in FIG. 3. Distance d2, also defined as CG-NA, may be no more than about 2.0 mm above the neutral axis 422, more preferably no more than about 1.50 mm above the neutral axis 422, and most preferably no more than about 1.0 mm above the neutral axis 422. It should be noted here that in FIG. 3, the CG 421 location is actually shown to be less than 0 mm and below the neutral axis, and distance d2 is about −0.50 mm, which still conforms to the ranges above without departing from the scope and content of the present invention. Another way to quantify a low CG 421 location is to define it relative to the ground plane 424, as shown by distance d3 in FIG. 3. This CG 421 height relative to the ground plane 424, which is also known as CG-Y-G, may generally be less than about 27.5 mm, more preferably less than about 27.1 mm, and most preferably less than about 26.7 mm, also without departing from the scope and content of the present invention.

As previously mentioned, the shifting of the CG 421 forward and lower, although critical to the present invention, does not paint the entire picture regarding the present invention. In fact, merely shifting the CG 421 within itself does not significantly improve the performance of the golf club head 400. The present invention not only achieves the current CG 421 criteria set fourth previously, but further improves upon the performance of the golf club head 400 by maintaining a high MOI along several key axes. The MOI-Y, which measures the MOI of the golf club head 400 about the y-axis, of the golf club head 400 in accordance with the present invention may generally be greater than about 4,000 g-cm$^2$, more preferably greater than about 4,500 g-cm$^2$, and most preferably greater than about 5,000 g-cm$^2$. The MOI-X, which measures the MOI of the golf club head 300 about the x-axis, of the golf club head 400 may generally be greater than 3,000 g-cm$^2$, more preferably greater than about 3,100 g-cm$^2$, and most preferably greater than about 3,200 g-cm$^2$.

Finally, the cross-sectional view of the golf club head 400 shown in FIG. 4 of the accompanying drawings allows the weighting mechanism 408 and its attachment to the lower striking face portion 404*b* to be shown. However, due to the intricate components of the weighting mechanism 408, an enlarged figure of circular region A shown in FIG. 4 is provided as FIG. 5 to better illustrate the weighting mechanism 408.

Figure 5:
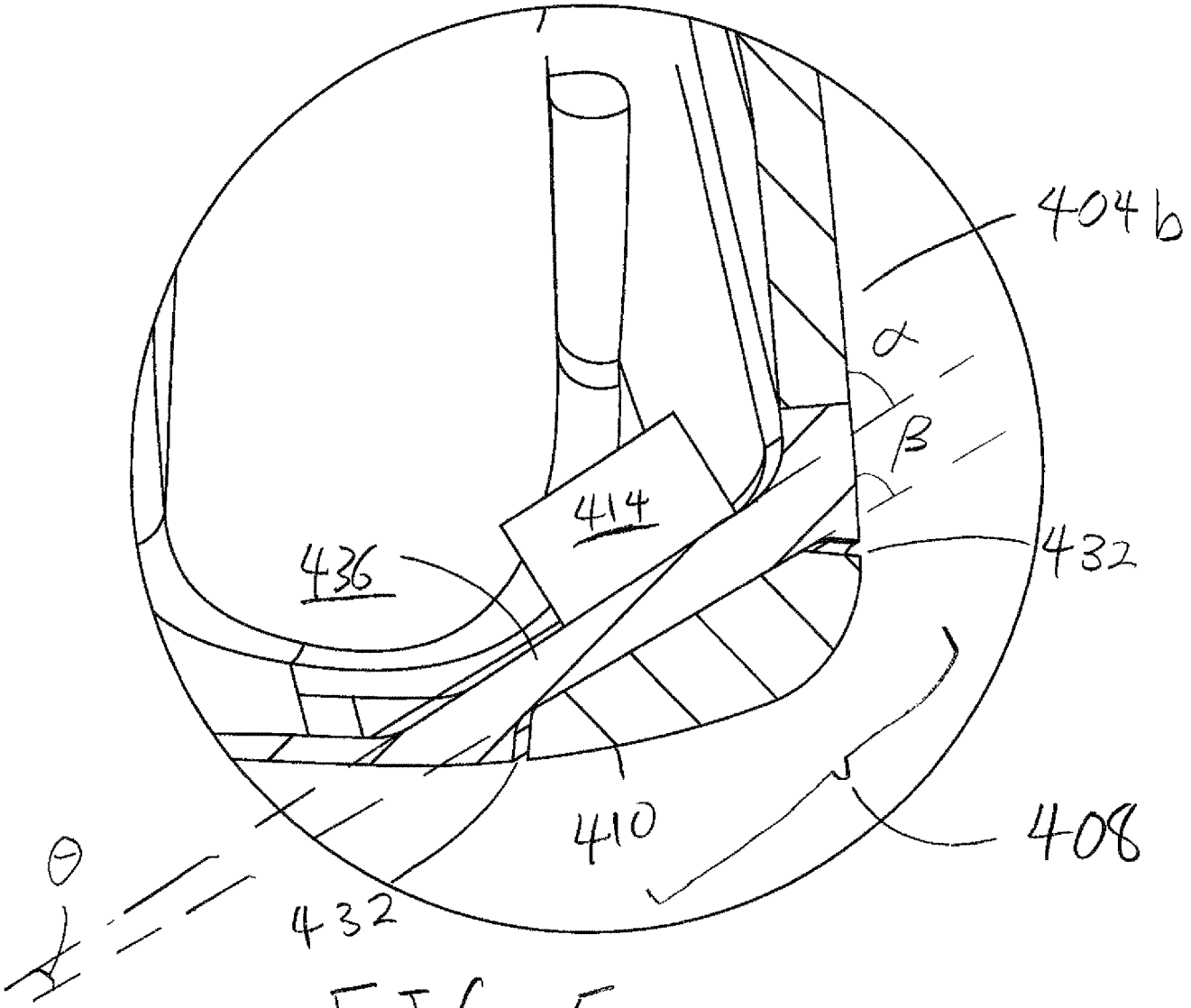
FIG. 5 of the accompanying drawings shows an enlarged cross-sectional view of a leading edge portion of a golf club head shown as circular region A in FIG. 4, in accordance with an exemplary embodiment of the present invention.

FIG. 5 of the accompanying drawings shows an enlarged cross-sectional view of the weighting mechanism 408 in more detail, allowing for the various key features of the weighting mechanism 408 to be shown. First and foremost, we can see that the weighting mechanism 408 is located at a bottom of the lower striking face portion 404*b*, as previously described. However, the enlarged view of the weighting mechanism 408 allows us to see that the location of the weighting mechanism 408 is so low on the lower striking face portion 404*b*, it forms the leading edge of the golf club head 400 itself. The leading edge of a golf club head 400, as generally known in the golf club industry, is lowest front most boundary of the striking face portion 404 where the striking face portion 404 meets the sole, but is can be more broadly defined as the entire curved surface of that leading edge of the golf club head 400 without departing from the scope and content of the present invention.

First and foremost, it is critical to note that the high density member 410 shown here is non-load-bearing, and is merely attached to a now chamfered leading edge 436 that bears the load and impact stressed when the golf club head 400 impacts a golf ball. Having the high density member 410 be non-load-bearing is critical to the present invention because material that have high density may generally not do well under high stress conditions, and preserving the ability to bear that high level of stress within the body portion will eliminate potential failure of the material.

In order to promote the non-load-bearing feature of the high density member 410, a gap 432 is provided around the perimeter of the high density member 410. In this enlarged cross-sectional view of the lower striking face portion 404*b*, the gap 432 appears both in front and behind the high density member 410, but in actuality, it exists completely around a perimeter of the high density member 410 in accordance with this embodiment of the present invention. However, in alternative embodiments of the present invention, the gap 432 may only partially encircle the perimeter of the high density member 410, or even eliminated completely so long as the high density member 410 is non-load-bearing all without departing from the scope and content of the present invention.

The high density member 410 in this embodiment, as previously described, is attached to the lower striking face portion 404*b* via attachment members 414 that utilizes oversized screwheads within the internal cavity of the golf club head 400 and elongate protrusions to engage the high density member 410. Here, shown in FIG. 5, the oversized screwhead of the heel biased attachment member 414 directly contacts an internal surface of the chamfered leading edge 436, while the high density weight member 410 directly contacts an internal surface of the chamfered leading edge 436.

The chamfered leading edge 436 shown here in this enlarged cross-sectional view of the golf club head 400 is also critical to the proper functioning of the present invention. As previously mentioned, due to the fact that the high density member 410 is non-load-bearing, the chamfered leading edge 436 of the present invention actually takes the entirety of the load generated when the golf club head 400 impacts a golf ball. In order to accommodate this, not only is the chamfer angle α critically important, but a separate lower chamfered wall angle β is introduced here to create a tapered chamfered leading edge 436 quantified by taper angle θ to help the chamfered leading edge 436 absorb the impact stresses at the lower striking face portion 404*b*. In this exemplary embodiment of the present invention, the chamfer angle α may generally be between about 60 degrees and about 70 degrees, more preferably between about 63 degrees and about 69 degrees, and most preferably between about 66 degrees and about 68 degrees, all without departing from the scope and content of the present invention. The lower chamfered wall angle β in accordance with the present invention may generally be between about 57 degrees and about 67 degrees, more preferably between about 60 degrees and about 66 degrees, and most preferably between about 63 degrees and about 65 degrees also without departing from the scope and content of the present invention. Finally, the taper angle θ in accordance with the present invention may generally be between about 1 degree and about 5 degrees, more preferably between about 2 degrees and about 4 degrees, and most preferably about 3 degrees.

Figure 6:
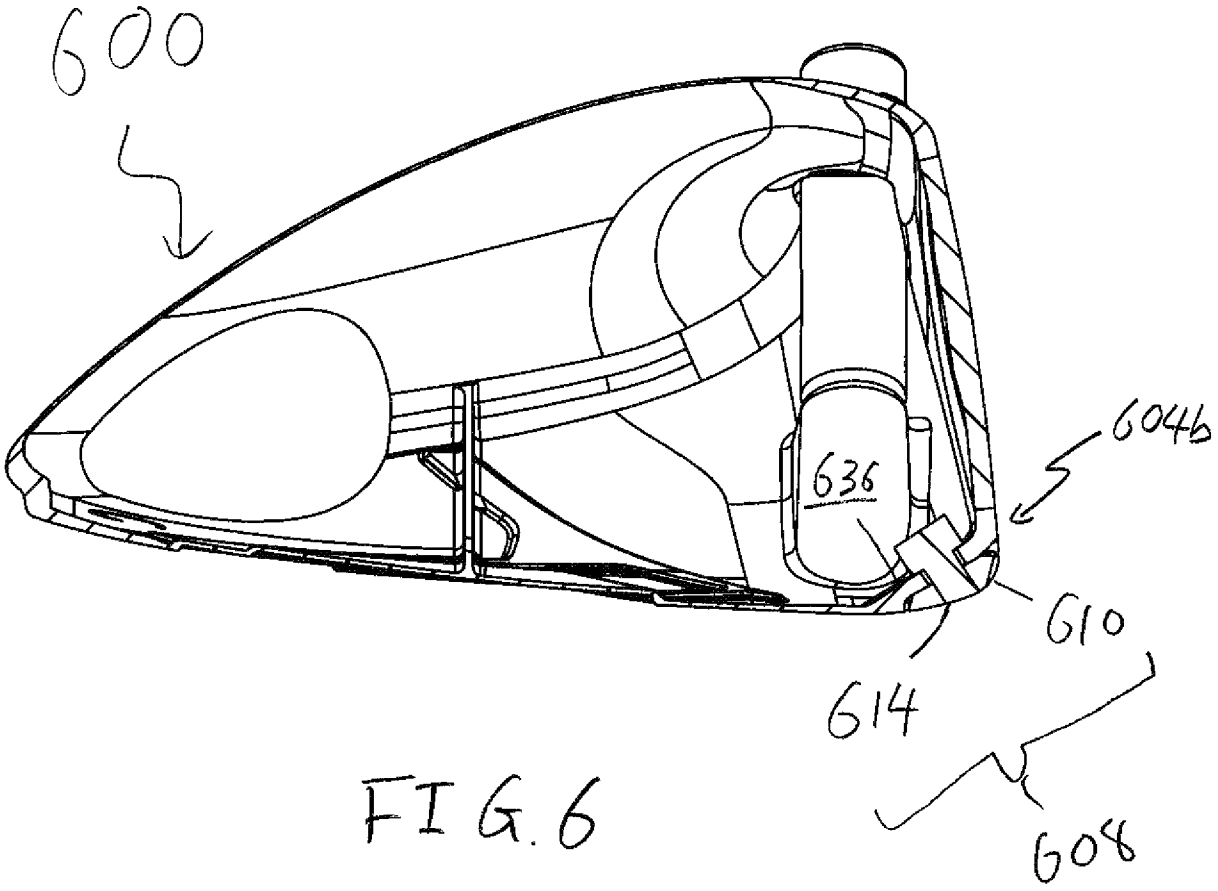
FIG. 6 of the accompanying drawings shows a cross-sectional view of a golf club head in accordance with an exemplary embodiment of the present invention taken along cross-sectional line 6-6' shown in FIG. 4.

FIG. 6 of the accompanying drawings shows a cross-sectional view of a golf club head 600, taken along cross-sectional line 6-6' shown in FIG. 3, allowing the heel biased attachment member 614 to be shown. In this embodiment of the present invention, the heel biased attachment member 614 is installed in the weighting mechanism 608 to help retain the high density member 610 in the lower striking face portion 604*b* of the golf club head 600. As previously mentioned, the present invention mechanically secures the high density member 610 to the chamfered leading edge 636 via the attachment member 614 with a gap to ensure that it is non-load-bearing, and this cross-sectional view of the golf club head 600 shown in FIG. 6 illustrates this.

Figure 7:
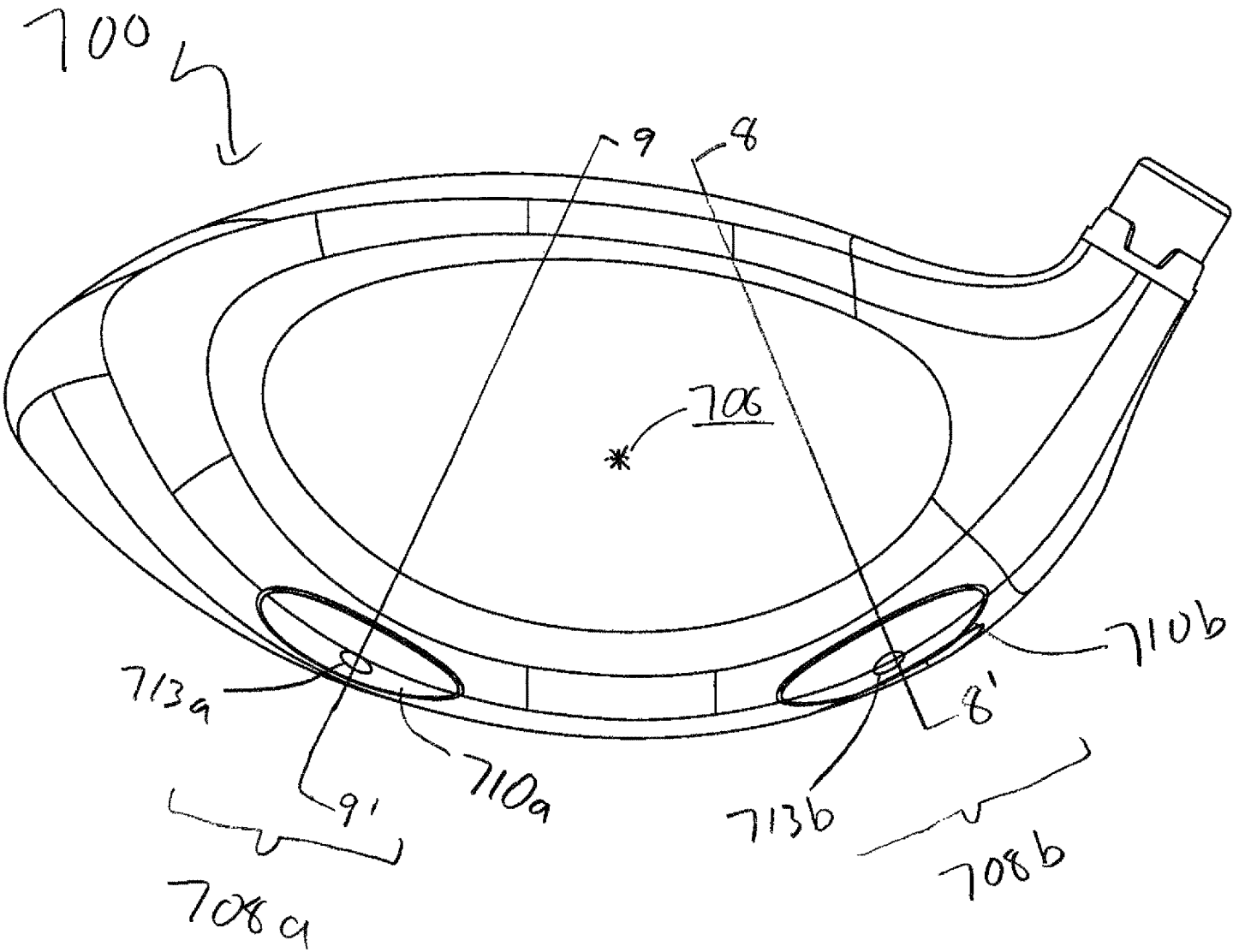
FIG. 7 of the accompanying drawings shows a frontal view of a golf club head in accordance with an alternative embodiment of the present invention, showing cross-sectional lines 8-8' and 9-9'.

FIG. 7 of the accompanying drawings shows a frontal view of a golf club head 700 in accordance with an alternative embodiment of the present invention. In this alternative embodiment of the present invention, the golf club head 700 has two weighting mechanisms 708*a* and 708*b* that are located along a toe and heel portion of the leading edge of the lower striking face portion of the golf club head 700. More specifically, the toe weighting mechanism 708*a* has a toe biased location along the leading edge of the lower striking face portion, while the heel weighting mechanism 708*b* has a heel biased location along the leading edge of the lower striking face portion. The toe weighting mechanism 708*a* shown in this embodiment also only has one toe attachment member 713*a* instead of the two previously shown, and the high density member 710*a* only has one opening to accommodate the singular attachment member 713*a*. Similarly, the heel weighting mechanism 708*b* shown in this embodiment mirrors the toe weighting mechanism 708*a* in its components, and only requires one heel attachment member 713*b* and one high density member 710*b*. Having two weighting mechanisms 708*a* and 708*b* that are now located on the heel and toe portion of the leading edge instead of the one may further help increase the MOI of the golf club head 700 but may not have achieve as low of a CG location.

It should be noted here that although the term "leading edge" used in the golfing industry refers to the lowest frontal boundary of a golf club head 700, the present invention utilizes a slightly broader definition that is still consistent with the general definition and understanding outlined above. More specifically, the term "leading edge" as used in the present disclosure, includes the entirety of the curved surface that forms the lowest frontal boundary of the golf club head 700, and toe weighting mechanism 708*a* and heel weighting mechanism 708*b* are also considered to be placed on the "leading" edge of the golf club head 700 within the context of the present invention.

In addition to the differences identified above, this alternative embodiment of the present invention shown in FIG. 7 may further differ from prior embodiments in that the attachment members 713*a* and 713*b* may not need to be a secondary piece having an oversized screwhead. In fact, attachment members 713*a* and 713*b* may be built right into the casting of the chamfered leading edge without departing from the scope and content of the present invention. In order to illustrate this feature, cross-sectional views of the golf club head 700 along cross-sectional lines 8-8' and 9-9' are presented as FIG. 8 and FIG. 9 respectively.

Figure 8:
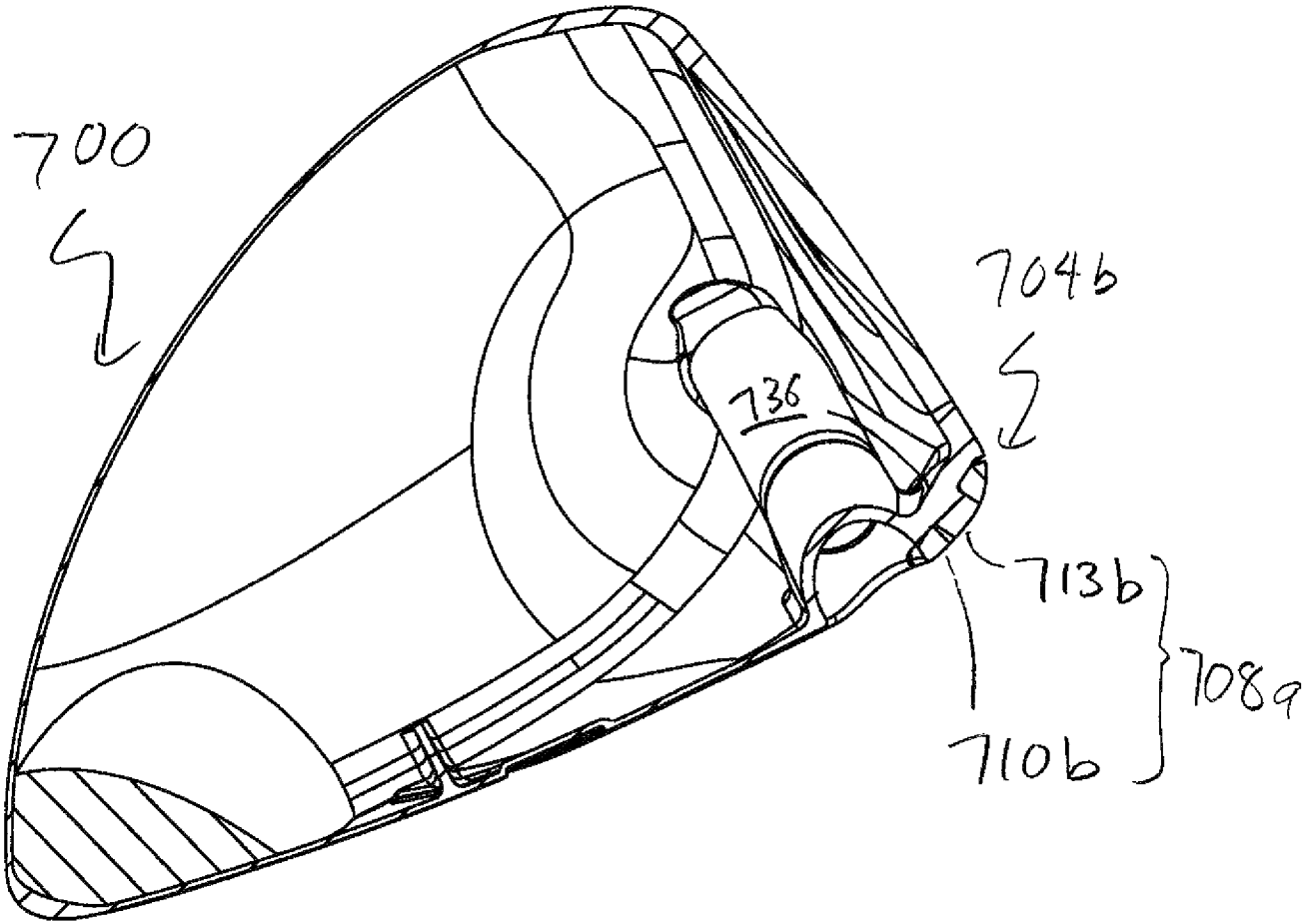
FIG. 8 of the accompanying drawings shows a cross-sectional view of a golf club head in accordance with an alternative embodiment of the present invention along cross-sectional line 8-8' shown in FIG. 7.
Figure 9:
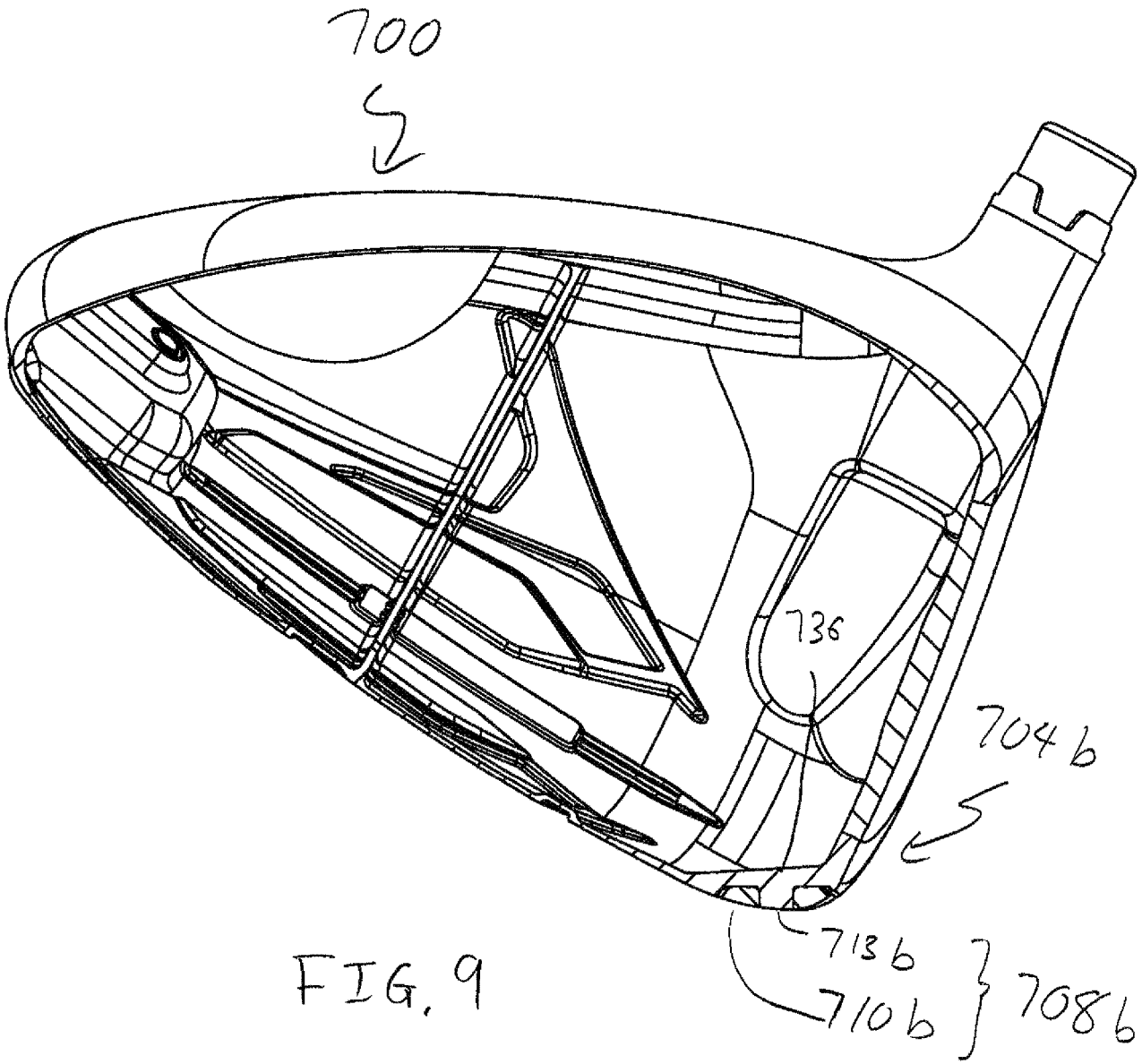
FIG. 9 of the accompanying drawings shows a cross-sectional view of a golf club head in accordance with an alternative embodiment of the present invention along cross-sectional line 9-9' shown in FIG. 7.

FIGS. 8 and 9 of the accompanying drawings show cross-sectional views of a golf club head 700 taken along cross-sectional line 8-8' and 9-9' respectively shown in FIG. 7. In this cross-sectional view of the invention, we can see that the attachment members 713*a* and 713*b* is formed directly into the body of the casting and is part of the chamfered leading edge 736 without departing from the scope and content of the present invention. This embodiment of the present invention shown in FIGS. 8 and 9 differs from previous embodiments in that the attachment members 713*a* and 713*b* are no longer formed out of a secondary piece such as a screw having an oversized screw head and elongate protrusion, thus reducing the number of components of golf club head 700. The attachment members 713*a* and 713*b* can be directly used to secure the high density member 710*a* and 710*b* respectively to form the weighting mechanism 708*a* and 708*b* at the lower striking face portion 704*b* of the golf club head 700 without departing from the scope and content of the present invention.

Figure 10:
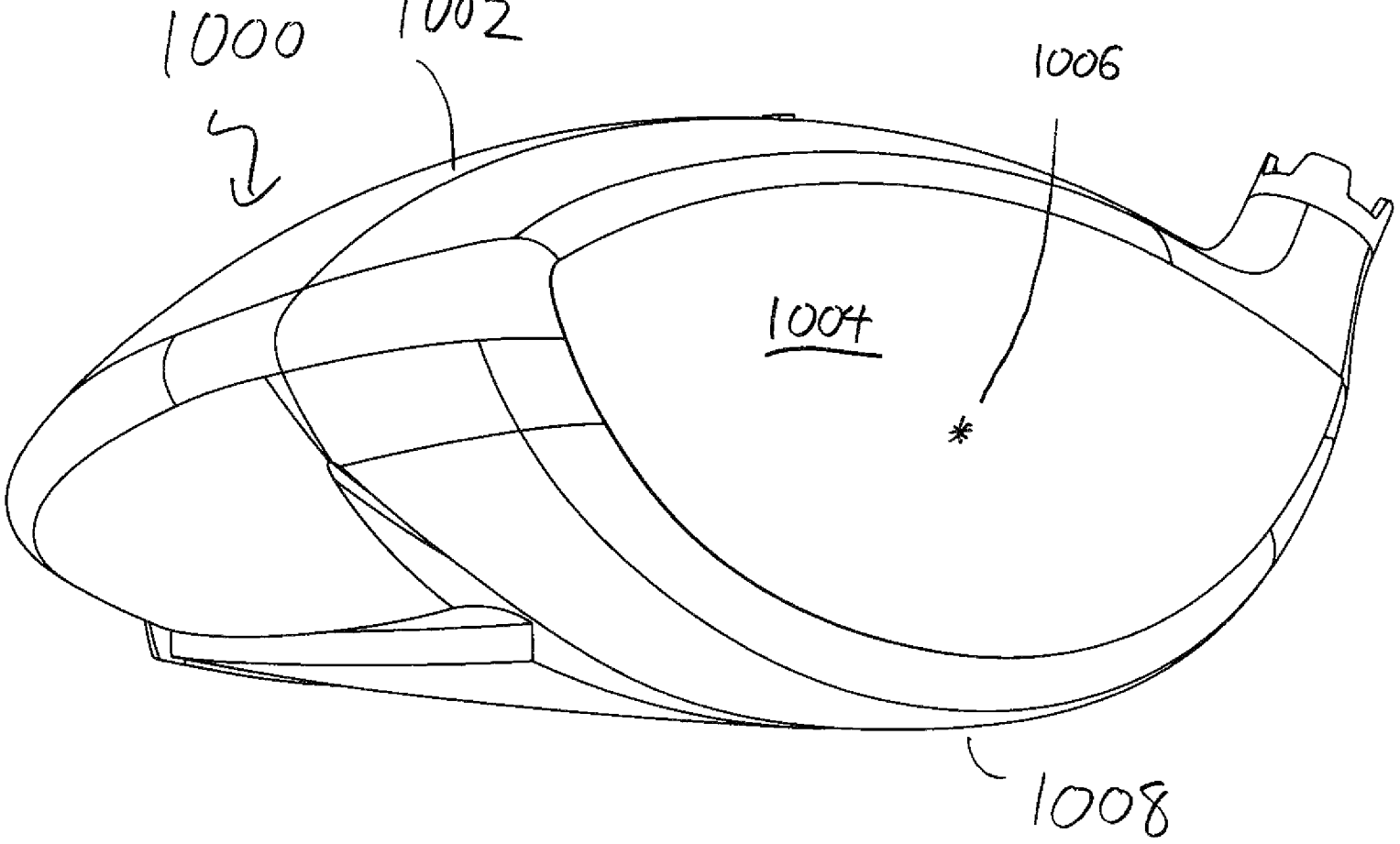
FIG. 10 of the accompanying drawings shows a perspective view of a golf club head in accordance with a further alternative embodiment of the present invention.

FIG. 10 of the accompanying drawings shows a perspective view of a golf club head 1000 in accordance with a further alternative embodiment of the present invention. Golf club head 1000 similar to above, is comprised out of a striking face portion 1004 and a body portion 1002, wherein the lower portion of the striking face portion 1004 includes a weighting mechanism 1008 attached to the leading edge of the golf club head 1000. The leading edge of the golf club head 1000, as previously discussed, is located at the bottom portion of the striking face portion 1004, with the top and bottom portion of the striking face portion 1004 separated by the geometric face center 1006 along the y-axis. (The coordinate system as well as the x, y, and z axes are the same throughout this disclosure. See coordinate system 101 in FIG. 1). This golf club head 1000, however, is different from previous embodiments in that the entirety of the leading edge portion of the golf club head 1000 is formed out of a secondary material to create the weighting mechanism 1008. In order to illustrate the various components, an exploded view of the golf club head 1100 is shown in FIG. 11.

Figure 11:
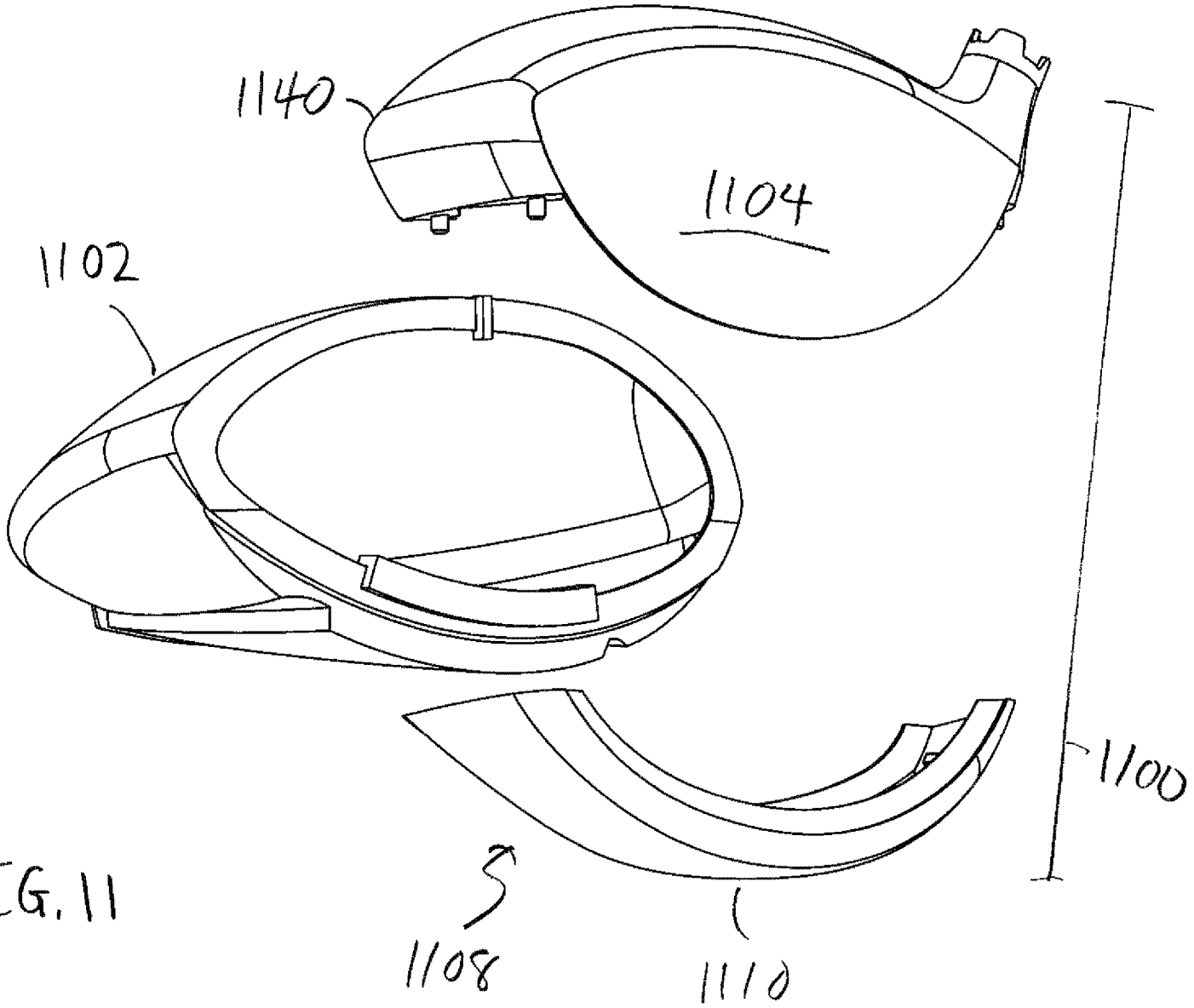
FIG. 11 of the accompanying drawings shows an exploded view of a golf club head in accordance with a further alternative embodiment of the present invention.

FIG. 11 of the accompanying drawings shows an exploded view of a golf club head 1100 in accordance with an alternative embodiment of the present invention. In this alternative embodiment of the present invention, the golf club head is separated into three components, the body portion 1102, the weighting mechanism 1108, and the frontal upper portion 1140. The weighting mechanism 1108 in this embodiment of the present invention, as previously discussed, may be made entirely out of the high density member 1110 to create extreme CG locations that is extremely low and extremely forward, all while preserving MOI properties. In this embodiment of the present invention, the high density member 1110 used to create the entirety of the weighting mechanism 1108 may be secured to the frontal upper portion 1140 of the golf club head 1100 via mechanical attachment mechanisms to ensure a solid bond between these two components; and these two components may be attached to the rear body portion 1102 via alternative bonding mechanisms methods that may or may not include the use of glue. It should be noted here that the specific attachment means to secure the various components of this golf club head 1100 can be shown in more detail in subsequent cross-sectional views of the present embodiment.

Figure 12:
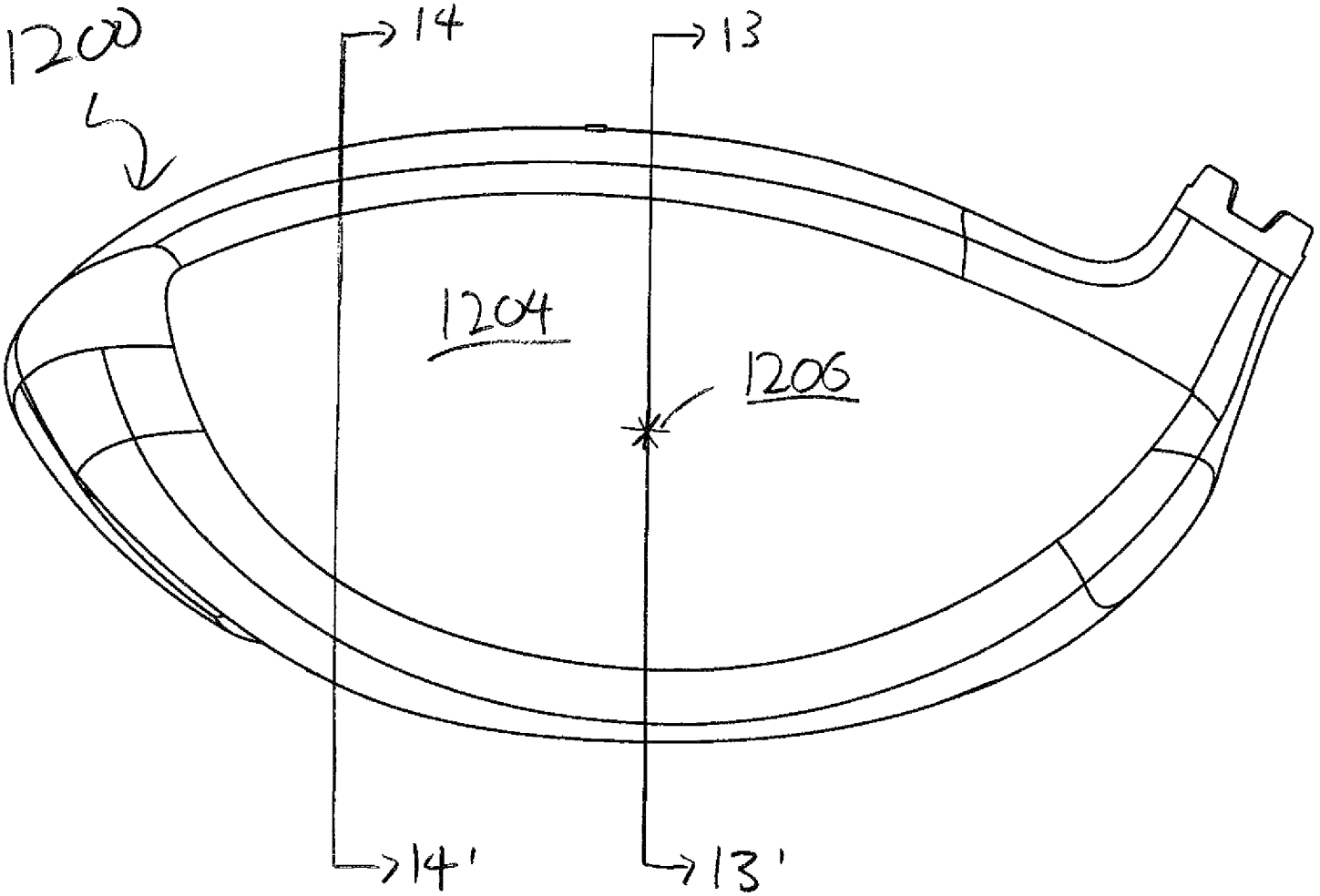
FIG. 12 of the accompanying drawings shows a frontal view of a golf club head in accordance with a further alternative embodiment of the present invention, showing cross-sectional lines 13-13' and 14-14'.

In order to provide cross-sectional views of golf club head 1100 in accordance with this embodiment of the present invention, a frontal view of the golf club head 1200 is shown with cross-sectional lines 13-13' and 14-14' highlighted here in FIG. 12. It should be noted here that cross-sectional line 13-13' passes vertically through the geometric center 1206 of the striking face portion 1204, while cross-sectional line 14-14' passes through a plane containing a toe joint mechanism (to be shown later).

Figure 13:
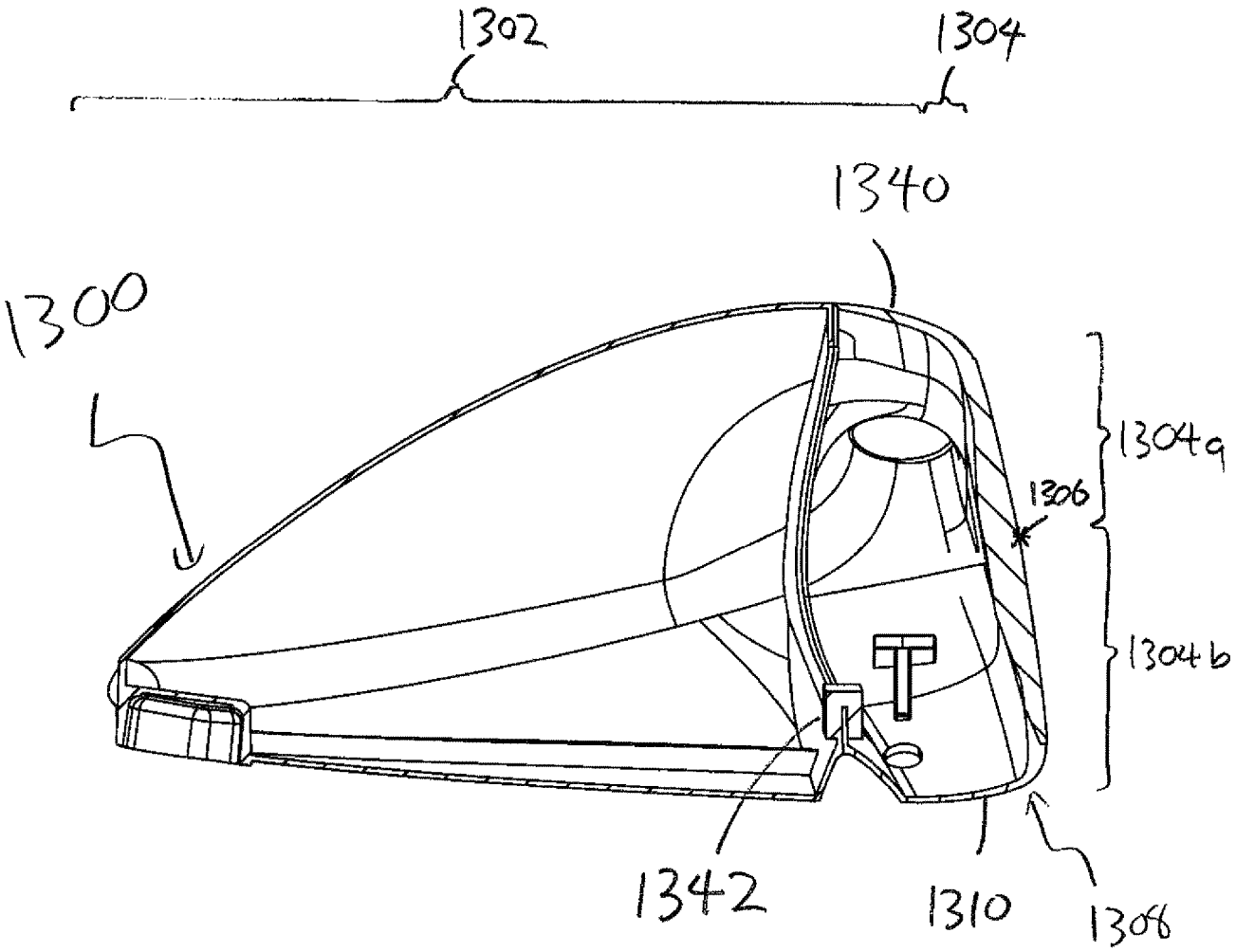
FIG. 13 of the accompanying drawings shows a cross-sectional view of a golf club head in accordance with a further alternative embodiment of the present invention taken along cross-sectional line 13-13' shown in FIG. 12.

FIG. 13 of the accompanying drawings shows a cross-sectional view of a golf club head 1300 in accordance with an exemplary embodiment of the present invention taken along cross-sectional line 13-13' shown in FIG. 12. In this cross-sectional view, we can see that the striking face portion 1304 is located at a frontal portion of the golf club head 1300, while the body portion 1302 is attached to the rear of the striking face portion 1304. The striking face portion 1304, similar to the discussion previously, relates to the portion of the golf club head 1300 that is substantially perpendicular to the ground plane, and stops being the striking face portion 1304 once it deviates from that plane. The striking face portion 1304, like previously mentioned, can be separated into an upper striking face portion 1304*a* and a lower striking face portion 1304*b*, having the geometric face center 1306 be the demarcation point between the two sub-components. However, in this embodiment, unlike the previous embodiment, the entirety of the leading edge of the golf club head 1300 is formed out of the high density member 1310 to create the weighting mechanism 1308 without the need of screws or posts. This type of construction is achievable because various other joint mechanisms are used to secure this weighting mechanism to 1308 to the golf club head 1300.

Unlike previous embodiments of the present invention wherein the weighting mechanisms (previously shown as 108 in FIG. 1) utilizes mechanical sub-components to achieve the high density member (previously shown as 110 in FIG. 1) to the golf club head (previously shown as 100 in FIG. 1), the present embodiment uses non-mechanical joining methods to secure the weighting mechanism 1308 to the frontal upper portion 1340. More specifically, in one example, the high density member 1310 could be formed of a weldable material that has a density higher than the frontal upper portion 1340 and attached directly to the frontal upper portion 1340 via welding. In other examples, the high density member 1310 may be swaged together with the frontal upper portion 1340 or brazed together with the frontal upper portion 1340 all without departing from the scope and content of the present invention. In a further alternative example, the entirety of the striking face portion 1304 may be formed via Direct Metal Laser Sintering (DMLS), 3D printing, or any other type of additive manufacturing techniques to include the different materials for the high density member 1310 and the frontal upper portion 1340, also without departing from the scope and content of the present invention. Alternatively, it can be said that the bond between the high density member 1310 and the frontal upper portion 1340 of the striking face portion 1304 of the golf club head 1300 could be formed by any non-mechanical methods of joining all without departing from the scope and content of the present invention.

In this alternative embodiment of the present invention, due to the fact that the upper frontal portion 1340 and the weighting mechanism 1308 formed out of the high density member 1310 are joined together to form a face cup, the joint between the front and rear of the golf club head 1300 also needs to be addressed. Central joint mechanism 1342 shown here in this cross-sectional view of the present invention in FIG. 13 illustrates how the frontal portion of the golf club head, which includes the upper frontal portion 1340 an the weighting mechanism 1308 made out of a high density member 1310, is joined to the rear portion of the golf club head 1300. In this embodiment of the present invention shown in FIG. 13, the golf club head 1300 utilizes a central joint mechanism 1342 is formed within the rear portion of the golf club head 1300 and may clamp onto the weighting mechanism 1308 to provide a means of attachment.

Figure 14:
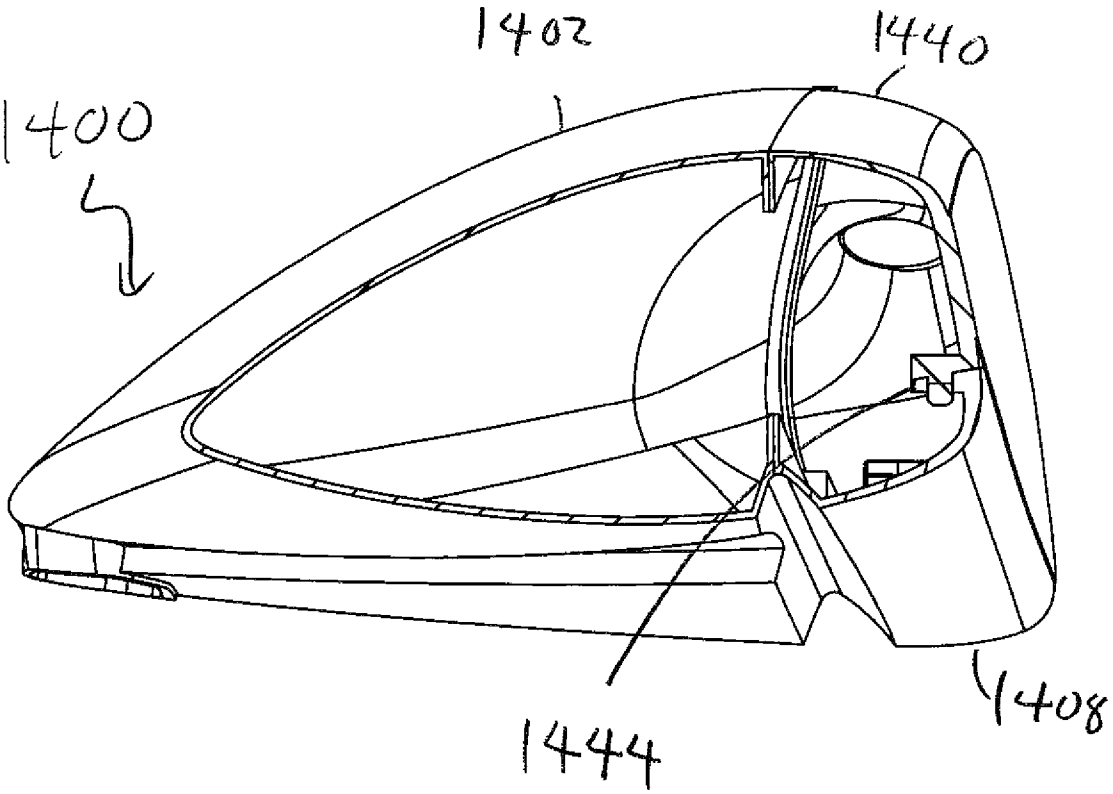
FIG. 14 of the accompanying drawings shows a cross-sectional view of a golf club head in accordance with a further alternative embodiment of the present invention taken along cross-sectional line 14-14' shown in FIG. 12.

In addition to the central joint mechanism 1342, the golf club head could also include additional mechanical joints in the heel and toe sections of the golf club head 1300. FIG. 14 of the accompanying drawings illustrates the additional mechanical toe joint 1444 by providing a cross-sectional view of a golf club head 1400 along cross-sectional line 14-14' shown in FIG. 12. In this cross-sectional view, the toe joint mechanism 1444, which is identical to the heel joint mechanism (not shown), provides an additional bond between the frontal upper portion 1440 and the weighting mechanism 1408 to further secure these two components together without departing from the scope and content of the present invention.

It should be noted that most of the embodiments discussed here aims to create a releasable hosel hole cover, however, all of these embodiments may include glue to make the hosel hole cover stay within the hosel hole, removing the ability to remove the hosel hoe cover without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head;

a body portion, made out of a first material having a first density, attached to a rear of said striking face portion, wherein said striking face portion further comprises;

an upper striking face portion located above a geometric center of said striking face portion, and a lower striking face portion located below a geometric center of said striking face portion, and wherein at least a portion of said lower striking face portion has a higher density than said upper striking face portion, wherein said golf club head has a CG-Z-FC less than about 40 mm from a face center, wherein said golf club head has a CG-NA of less than about 2 mm above a neutral axis, wherein said golf club head has a MOI-Y of greater than about 4,000 g-cm$^2$, wherein said lower striking face portion further comprises a weighting mechanism, wherein said weighting mechanism encompasses a portion of a leading edge portion of said golf club head, and wherein said weighting mechanism further comprises;

a high density member, made out of a second material having a second density, wherein said second density is greater than said first density.

2. The golf club head of claim 1, wherein said second density is greater than about 7.5 g/cm$^3$.

3. The golf club head of claim 2, wherein said second density is greater than about 14 g/cm$^3$.

4. The golf club head of claim 1, wherein said weighting mechanism further comprises:

an attachment member, adapted to engage an opening in said high density member, wherein said attachment member secures said high density member to said leading edge portion of said golf club head.

5. A golf club head comprising:

a striking face portion located at a frontal portion of said golf club head;

a body portion, made out of a first material having a first density, attached to a rear of said striking face portion, wherein said striking face portion further comprises;

an upper striking face portion located above a geometric center of said striking face portion, and a lower striking face portion located below a geometric center of said striking face portion further comprising a leading edge portion, and wherein said leading edge portion further comprises;

a chamfered leading edge, wherein said chamfered leading edge has a chamfer angle of between about 60 degrees to about 70 degrees, wherein said golf club head has a CG-Z-FC less than about 40 mm from a face center, wherein said golf club head has a CG-NA of less than about 2 mm above a neutral axis, and wherein said golf club head has a MOI-Y of greater than about 4,000 g-cm$^2$.

6. The golf club head of claim 5, wherein said leading edge portion has a density greater than a density of said upper striking face portion.

7. The golf club head of claim 6, wherein said chamfer angle is between about 63 degrees to about 69 degrees.

8. The golf club head of claim 7, wherein said chamfer angle is between about 66 degrees to about 68 degrees.

9. The golf club head of claim 5, wherein said chamfered leading edge is tapered, having a taper angle of between about 1 degree to about 5 degrees.

10. The golf club head of claim 9, wherein said taper angle is between about 2 degrees to about 4 degrees.

11. The golf club head of claim 10, wherein said taper angle is about 3 degrees.

12. A golf club head comprising:

a striking face portion located at a frontal portion of said golf club head;

a body portion, made out of a first material having a first density, attached to a rear of said striking face portion, wherein said striking face portion further comprises;

an upper striking face portion located above a geometric center of said striking face portion, and a lower striking face portion located below a geometric center of said striking face portion, and wherein at least a portion of said lower striking face portion has a higher density than said upper striking face portion, wherein at least a portion of said lower striking face portion further comprises a weighting mechanism further comprising;

a high density member, made out of a second material having a second density, and an attachment member, adapted to engage an opening in said high density member, wherein said second density is greater than said first density, wherein said attachment member secures said high density member to a leading edge portion of said golf club head, and where said weighting mechanism encompasses a portion of said leading edge portion of said golf club head.

13. The golf club head of claim 12, wherein said second density is greater than about 7.5 g/cm$^3$.

14. The golf club head of claim 13, wherein said second density is greater than about 14 g/cm$^3$.

* * * * *